US007785130B2

(12) United States Patent
Chen et al.

(10) Patent No.: US 7,785,130 B2
(45) Date of Patent: Aug. 31, 2010

(54) CABLE END CONNECTOR HAVING IMPROVED LATCH

(75) Inventors: Yong-Jun Chen, ShenZhen (CN); Qing-Sheng Gao, ShenZhen (CN); Xian-Kui Shi, ShenZhen (CN); Chung-Yen Yang, TuCheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/384,831

(22) Filed: Apr. 9, 2009

(65) Prior Publication Data

US 2009/0258526 A1 Oct. 15, 2009

(30) Foreign Application Priority Data

Apr. 9, 2008 (CN) ..... 2008 2 0035062

(51) Int. Cl.
*H01R 13/627* (2006.01)

(52) U.S. Cl. ..... 439/354

(58) Field of Classification Search ..... 439/353, 439/358, 352, 354, 357
See application file for complete search history.

(56) References Cited

U.S. PATENT DOCUMENTS

| | | | | |
|---|---|---|---|---|
| 6,319,043 | B1 * | 11/2001 | Takatsuki et al. | 439/358 |
| 6,364,685 | B1 * | 4/2002 | Manning | 439/357 |
| 6,585,537 | B1 | 7/2003 | Lee | |
| 7,160,136 | B2 * | 1/2007 | Zhang et al. | 439/357 |
| 2006/0110969 | A1 | 5/2006 | Wu et al. | |

* cited by examiner

*Primary Examiner*—Neil Abrams
(74) *Attorney, Agent, or Firm*—Wei Te Chung; Andrew C. Cheng; Ming Chieh Chang

(57) ABSTRACT

A cable end connector includes an insulative housing (2) with a top surface (204), a number of contacts (4) received in the housing and a latch member (5). The latch member is integrally molded with the housing, and comprises a pair of latches (501, 503), a depressible releasing actuator (504) connecting with the latch and a biasing arm (502) extending from the depressible releasing actuator. The respective end of the latch and the biasing arm is attached to the top surface of the housing, and the other end of is located away from the top surface. The biasing arm is lower than the latch neither in an normal condition nor in a depressed condition.

5 Claims, 4 Drawing Sheets

CABLE END CONNECTOR HAVING IMPROVED LATCH

BACKGROUND OF THE INVENTION

1. Field of the Invention

The present invention relates generally to a cable end connector, and particularly to a cable end connector having a latch to effectively establish its engagement and disengagement with a complementary connector.

2. Description of Related Patent

Many electrical connectors include latch means for retaining a pair of electrical connector housings in a mated condition. For example, U.S. PUB. NO. 2006/0110969 shows a cable assembly with a latch integrally and pivotally connected to a corresponding connector. The latch comprises a pair of deflectable arms, a flexible arm located between the deflectable arms and a press portion. The respective ends of deflectable arms and the flexible arm are connected to the top surface of the housing, and the other end of the deflectable arms and the flexible arm are connected by the press portion which is separate from the top surface of the housing. The deflectable arms are higher than the flexible arm. Each deflectable portion further forms a lock member. When the cable end connector mates with the corresponding connector, the press portion is depressed downwardly, and the lock members of the deflectable portions engaged with gaps on the corresponding connector to keep the two connectors in a mated condition. Because the moment operational on the deflectable portions is smaller than on the flexible arm, the flexible arm will extend out of the top surface of the deflectable portions. In this condition, the flexible arm will be broken off easily when the flexible arm is crashed by an external material.

Hence, it is desirable to have an improved latch for a cable end connector to overcome the above-mentioned disadvantages.

BRIEF SUMMARY OF THE INVENTION

Accordingly, the object of the present invention is to provide a cable end connector having an improved latch, thereby, preventing the latch from being broken.

In order to achieve the above-mentioned object, a cable end connector comprises: an insulative housing with a top surface, a plurality of contacts received in the housing, and a latch member integrally molded with the housing. The latch member comprises a pair of latches, a depressible releasing actuator connecting the pair of latches and a biasing arm extending from the depressible releasing actuator. Both of the latches and the biasing arm have one end attached to the top surface of the housing and the other end cantilevered therefrom. The biasing arm is lower than the latch along a transverse direction neither in an normal condition nor in a depressed condition.

Other objects, advantages and novel features of the invention will become more apparent from the following detailed description of the present embodiment when taken in conjunction with the accompanying drawings.

DETAILED DESCRIPTION OF THE INVENTION

Figure 1:
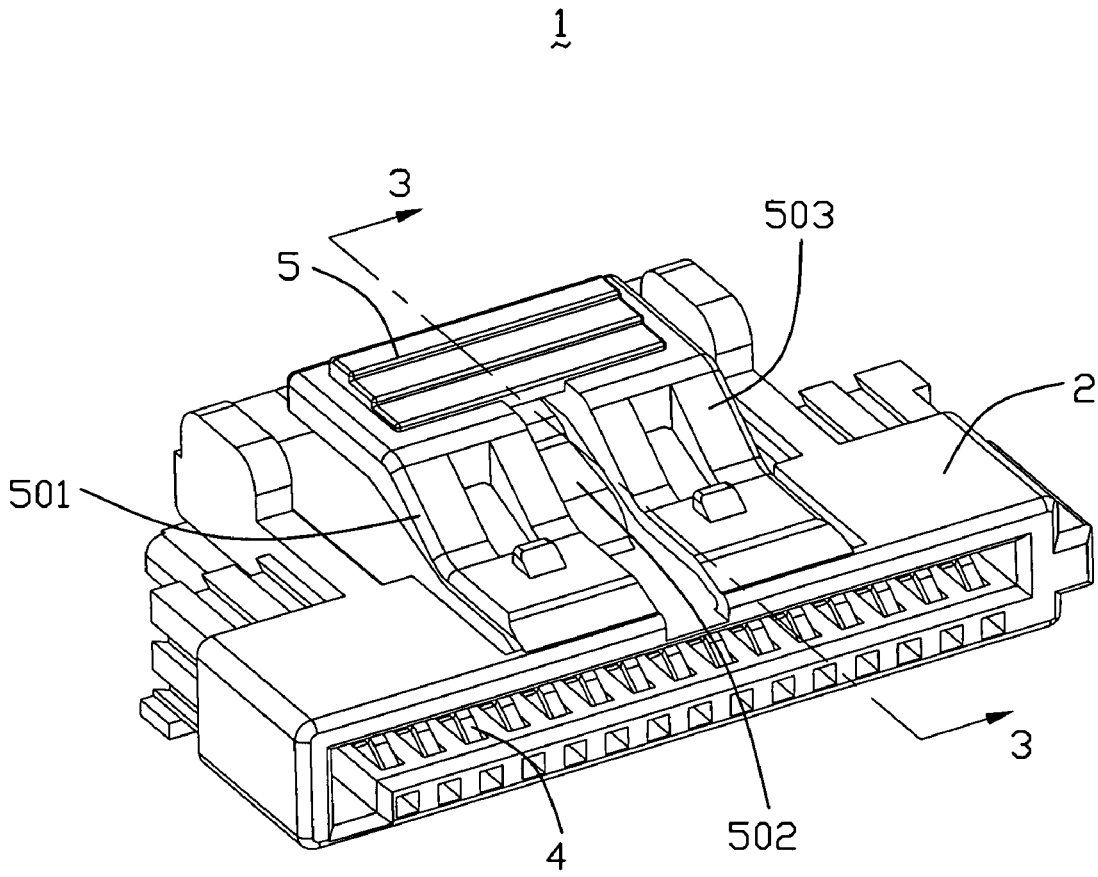
FIG. 1 is a perspective view of a cable end connector in accordance with the present invention.
Figure 2:
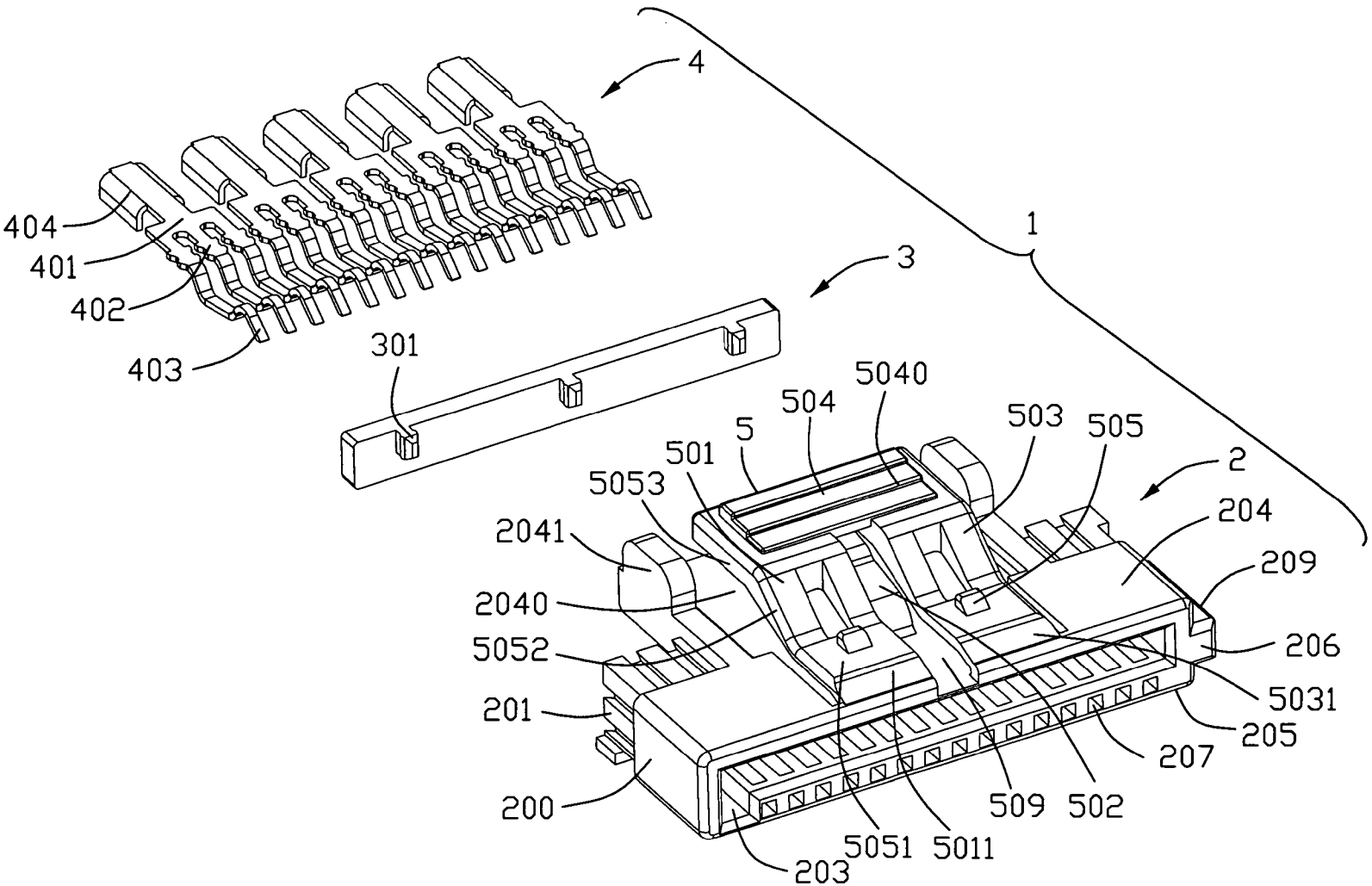
FIG. 2 is an exploded, perspective view of the cable end connector shown in FIG. 1.

Reference will now be made to the drawing figures to describe the present invention in detail.

Referring to FIG. 1 to FIG. 4, a cable end connector 1 made in accordance with the present invention comprises an insulative housing 2 with a plurality of contacts 4 assembled therein, a latch member 5 integrally molded with the housing 2 and a spacer 3 assembled to the housing 2.

The insulative housing comprises a main portion 200 with a substantially rectangular configuration, and an extending portion 201 rearwardly extending from the main portion 200. The main portion 200 defines a top surface 204 and a mating face 205. The top surface 204 and the mating face 205 form a jointing line 206. A receiving cavity 203 with an L-shaped configuration in a front-to-back direction receives a mating tongue (not shown) of a complementary connector (not shown). A plurality of contact channels 207 are formed in the main portion 200, and extending through the main portion 200 and the extending portion 201. The housing 2 further defines a support portion 2040 rearwardly extending from the main portion 200 and beyond the extending portion 201. A pair of protrusions 2041 are respectively disposed on opposite sides of the support portion 2040 for preventing the external element or device from hooking with the latch member 5. A tuber 209 is disposed on one lateral side of the housing 2.

The latch member 5 comprises a first latch 501, a second latch 503 in parallel to the first latch 501, a depressible releasing actuator 504 integrally molded with the first and second latches 501, 503, and a biasing arm 502 forwardly and downwardly extending from a bottom surface of the depressible releasing actuator 504 and located between the first and the second latches 501, 503. The first latch 501 includes a first anchoring end 5011 connecting to and backwardly from the top surface 204. The second latch 503 also includes a second anchoring end 5031 connecting to and extending upwardly and backwardly from the top surface 204. The first latch 501 has a similar structure to that of the second latch 503. The first and second latches 501, 503 each comprises a base portion 5051 extending from the first and the second anchoring ends 5011, 5031 respectively, a cantilevered portion 5053 integrally formed with the depressible releasing actuator 504 and disposed above the support portion 2040, and a deflectable arm portion 5052 connecting the base portion 5051 to the cantilevered portion 5053. Each base portion 5051 has a ramped locking protrusion 505 formed thereon. The biasing arm 502 extends from the actuator 504 toward the top surface 204 of the housing 2 with a front end 5021 integrally molded with the top surface 204. The front end 5021 is disposed in the gap 509 and behind the jointing line 206. The width of the biasing arm 502 is slightly smaller than a dimension of a gap 509 between the first and the second latches 501, 503. The biasing arm 502 is formed to allow the latch member 5 gaining enough restorative force therein. The biasing arm 502 is lower than the first and the second latches 501, 503 in either its normal condition or its depressed condition to prevent the biasing arm 502 from being broken, when subject to an undesired external pressure. It is noted that the biasing arm 502 essentially includes a front section 5022 and a rear section 5024 with a middle offset section 5023 so as to lower the front section 5022 for protection consideration during depressed condition. The depressible releasing actuator 504 defines a plurality of steps 5040 for providing enough friction to grasp.

Each contact 4 comprises a base 401, three retention portions 402 extending forwardly from the base 401, three mating ends 403 extending forwardly from corresponding retention portions 402, and a tail end 404 extending rearwardly from the base 401 for receiving a plurality of conductive wires of a cable (not shown).

The spacer 3 comprises a body portion 30 generally of a rectangular configuration. A plurality of protruding ribs 301 projects forwardly from an edge of the body portion 30.

Figure 3:
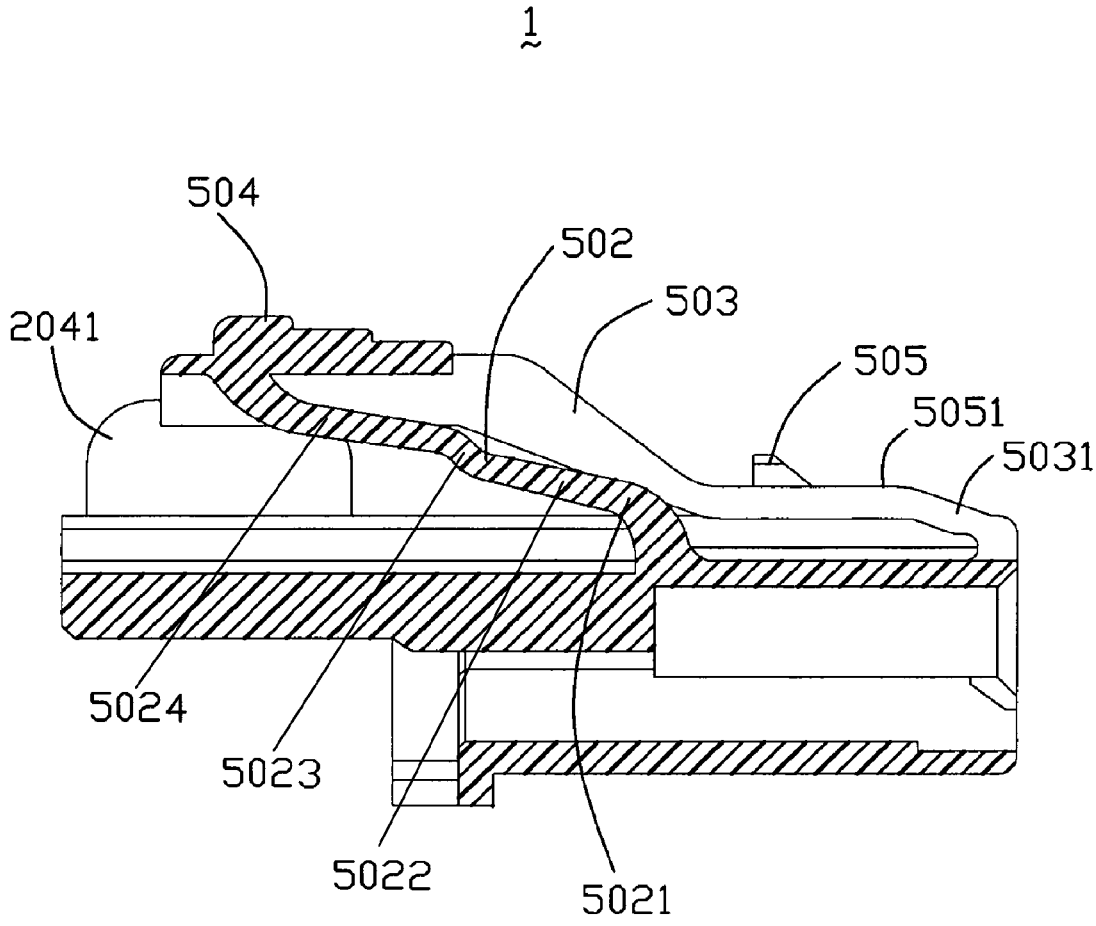
FIG. 3 is a cross-sectional view of the latch of the cable end connector in an normal position.
Figure 4:
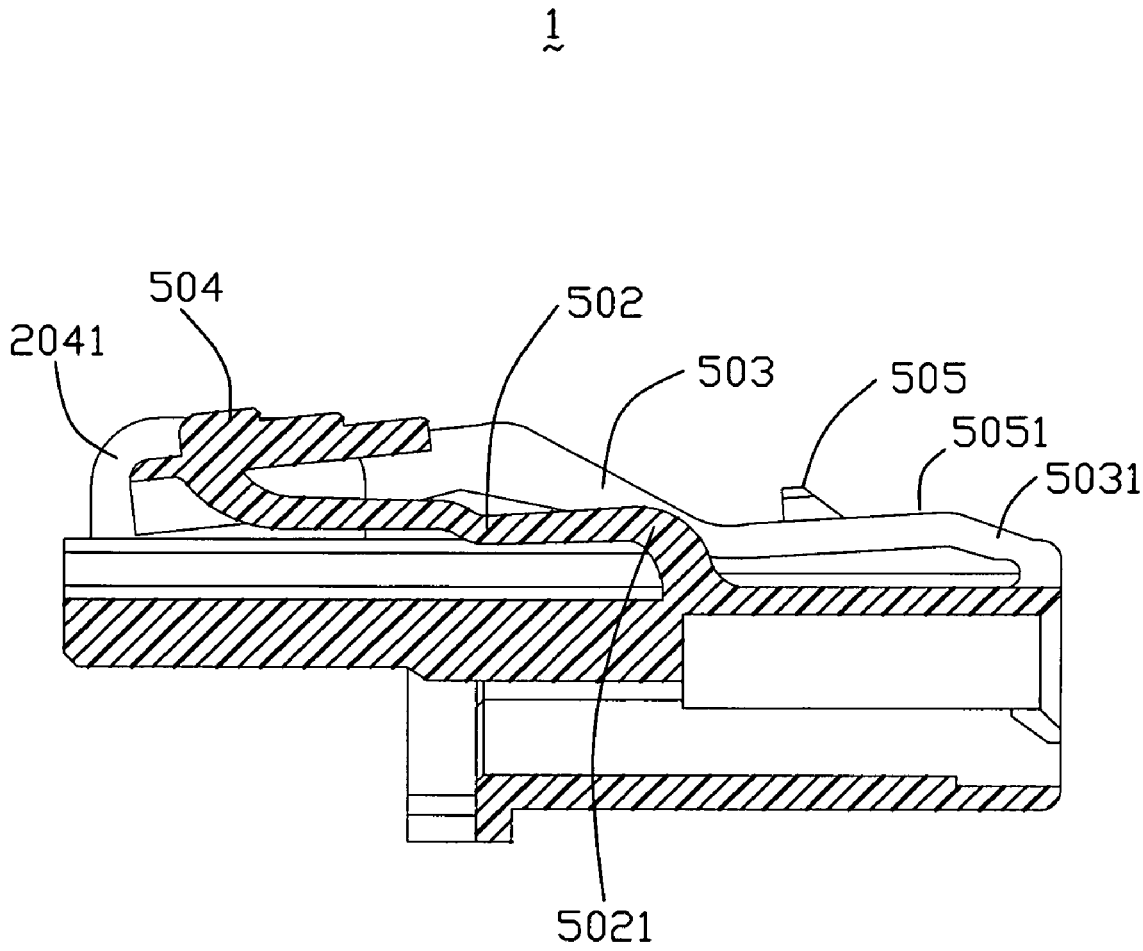
FIG. 4 is a cross-sectional view of the latch of the cable end connector in a depressed position.

Referring to FIGS. 3 and 4, in mating, the latch member 5 is deflected toward the surface of the support portion 2040 when the cable end connector 100 engages the complementary connector. The locking protrusions 505 will align with and engage to the locking apertures (not shown) of the complementary connector thereby holding the two connectors in a mated condition. In disengagement, a downward force is exerted on the depressible releasing actuator 504 to urge the latch member 5 towards the surface of the support portion 2040 and disengage from the locking aperture of the complementary connector. The problem discussed in the prior art is solved as follow. When the biasing arm 502 is located in the normal condition (referring to FIG. 3), the front end 5021 of the biasing arm 502 is lower than the first and the second latches 501, 503 in a transversal direction. When the biasing arm 502 is pressed downwardly and located in the depressed condition (referring to FIG. 4), the front end 5021 of the biasing arm 502 is still lower than the first and second latches 501, 503. The biasing arm 502 do not extend beyond of the top surface of the first and second latches 501, 503, thereby preventing the biasing arm 502 from being broken off.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulative housing having a plurality of contacts therein;

a latch member unitarily formed on a face of the housing, said latch member including a resilient latch arm having a locking head thereon and thereof a first root section extending rearwardly in a front-to-back direction from a first position of the face in a cantilevered manner, and a biasing arm having a second root section extending rearwardly from a second position of the face in another cantilevered manner, a free end section of the latch arm and that of the biasing arm being joined together; wherein the biasing arm is offset from the latch arm in a transverse direction for injection molding consideration while the second root section is protectively located under the latching arm even though said latch arm is downwardly depressed toward the face in a vertical direction perpendicular to said front-to-back direction; wherein the second root section defines a front section and a rear section with a middle offset section therebetween to lower the front section.

2. The cable assembly as claimed in claim 1, wherein said biasing arm is shorter than the latch arm.

3. The cable assembly as claimed in claim 1, wherein there are two said latch arms and the biasing arm is located therebetween in a transverse direction perpendicular to said front-to-back direction and said vertical direction.

4. The cable assembly as claimed in claim 1, wherein the front section and the rear section are essentially parallel to each other while the middle offset section is essentially oblique to both said front section and said rear section.

5. The cable assembly as claimed in claim 1, wherein said middle offset section is essentially located under a front edge of the joined free end section of the latch arm and that of the biasing arm in the vertical direction.

* * * * *